US005702225A

United States Patent [19]

Ghibaudo

[11] Patent Number: 5,702,225

[45] Date of Patent: Dec. 30, 1997

[54] BOOMLESS AUTOMATED SIDE LOADER FOR REFUSE COLLECTION VEHICLE HAVING LIFT ARM WITH NON-EXTENDABLE UPPER END

[75] Inventor: Jose A. Ghibaudo, Alta Loma, Calif.

[73] Assignee: Amrep, Inc., Ontario, Calif.

[21] Appl. No.: 658,325

[22] Filed: Jun. 5, 1996

[51] Int. Cl.[6] ..... B66F 3/04

[52] U.S. Cl. ..... 414/408; 414/409; 414/786

[58] Field of Search ..... 414/406, 408, 414/409, 303, 486, 487, 540, 541, 629, 631, 632, 700, 733, 786

[56] References Cited

U.S. PATENT DOCUMENTS

| | | | |
|---|---|---|---|
| Re. 34,292 | 6/1993 | Bingman et al. | 414/408 |
| 3,910,434 | 10/1975 | Ebeling et al. | 414/408 |
| 4,057,156 | 11/1977 | Thompson et al. | 414/408 |
| 4,219,298 | 8/1980 | Stragier et al. | 414/409 |
| 4,552,500 | 11/1985 | Ghibaudo et al. | 414/408 |
| 4,699,557 | 10/1987 | Barnes | 414/408 |
| 5,049,026 | 9/1991 | Bingman et al. | 414/408 |
| 5,360,310 | 11/1994 | Jones et al. | 414/409 |

FOREIGN PATENT DOCUMENTS

| | | |
|---|---|---|
| 3828-845-A | 8/1988 | Germany . |
| 1283-165-A | 3/1985 | U.S.S.R. . |
| 1299-005-A | 3/1987 | U.S.S.R. . |
| 1569-286-A | 4/1988 | U.S.S.R. . |
| 2 168 316 | 6/1986 | United Kingdom . |

OTHER PUBLICATIONS

Amrep, Inc., Amocaslpo–19.21, Automated Curb–Side Refuse Collection Unit, Parts and Service Manual, Jan. 3, 1995.

*Primary Examiner*—David A. Bucci

*Attorney, Agent, or Firm*—Baker, Maxham, Jester & Meador

[57] ABSTRACT

A lift arm is pivotally supported between its upper and lower ends on the outer ends of a pair of horizontal support rails. The support rails slide beneath the body of the refuse collection vehicle across its width. A pair of opposing refuse container grippers are mounted on a carriage that reciprocates along the length of the lift arm to a curved upper portion for dumping refuse from the container into a hopper section of body. The opposite sides of the curved upper portion of the lift arm are pivotally connected to the vehicle body adjacent the hopper section. A hydraulic piston and cylinder drive assembly is mounted between the horizontal rails beneath the vehicle body for extending and retracting the lift arm from the side of the body. The lower end of the lift arm follows a curvilinear or arcuate path during extension and retraction. The upper end of the lift arm does not extend when its lower end is extended so that refuse is always dumped at the same position relative to the hopper section of the vehicle body regardless of the amount of extension of the lift arm.

20 Claims, 6 Drawing Sheets

BOOMLESS AUTOMATED SIDE LOADER FOR REFUSE COLLECTION VEHICLE HAVING LIFT ARM WITH NON-EXTENDABLE UPPER END

BACKGROUND OF THE INVENTION

The present invention relates to refuse collection, and more particularly, to an improved automated apparatus extendable from the side of a refuse collection vehicle to grip, elevate and dump a refuse container positioned curbside.

Household garbage or refuse has long been deposited into garbage cans or refuse containers which have been manually picked up by trash men and dumped into refuse collection trucks or other vehicles equipped with compactors. This usually requires both a human driver and a human loader, the latter hanging on the back end of the truck as it drives down the street. The loaders often suffer low back and shoulder injuries. They are also sometimes injured by falling off the truck, and in rare cases, by failing to stay clear of the trash compactors. Extreme weather conditions often make this tedious and dangerous work even more uncomfortable. All too often the trash men spill garbage and do not replace the garbage cans upright with their lids in place.

In order to overcome the costs, risks and tedium of manual refuse collection, municipalities and waste management service companies have begun to utilize automated refuse collection apparatus on an even increasing scale. One configuration that has attained popularity is the so-called automated side loader. It typically comprises a driver operated lift arm mounted for extension and retraction on the side of the refuse collection vehicle. The lift arm has grippers for grabbing the refuse container on the curb. The container is moved upwardly along the inclined lift arm to its curved upper portion by a chain or other elevating apparatus. This inverts the container so that its hinged lid swings open, allowing the refuse to dump into an upwardly opening hopper section of the body of the refuse collection vehicle.

It is important that automated side loaders for refuse collection have so-called "extended reach." This allows them to reach between parked cars to grab a refuse container sitting on the sidewalk. In the past, automated side loaders have included swinging booms connected between the lift arm and vehicle utilizing complex pivoting mounting linkages to permit both the upper and lower ends of the lift arm to move outwardly from the vehicle together. See U.S. Pat. No. Re. 34,292 of Bingman, et al. While this has enabled extended reach, the result is a dump position relative to the hopper section which varies depending upon how far the lift arm has to be extended to grab the refuse container. It is too time consuming to retract the lift arm before raising and dumping the refuse container. The variable dump position occasionally leads to refuse being dumped over the far or near sides of the hopper section of the vehicle body. The hopper section may have to be extended outward from the side of the vehicle body beyond legal limits. The booms are heavy and the lift arm tends to shake when carrying a cantilevered load. The complex mounting linkages are subjected to tremendous stress and can therefore fail, resulting in costly repairs and downtime. The lift arm can be hung up on the vehicle body when it is tilted rearwardly for dumping.

It is preferable to mount the side loader to the body of the refuse collection vehicle instead of the frame of the vehicle. This makes the side loader more stable during operation than if it were pivotally connected only to the lower frame of the vehicle as disclosed in the aforementioned Bingman, et al. patent. It also prevents the side loader from being damaged if the body is tilted at the wrong time to dump its contents from the rear door.

SUMMARY OF THE INVENTION

It is therefore the primary object of the present invention to provide an improved automated side loader for refuse collection.

It is another object of the present invention to provide an improved boomless automated side loader for refuse collection.

It is another object of the present invention to provide an improved boomless automated side loader for refuse collection having extended reach.

It is another object of the present invention to provide an improved boomless automated side loader for refuse collection having a uniform dumping position.

According to the illustrated embodiment of the present invention a lift arm is pivotally supported between its upper and lower ends on the outer end of at least one horizontal support rail. The support rail slides beneath the body of the refuse collection vehicle across its width. A gripping mechanism holds a refuse container and reciprocates along the length of the lift arm to a curved upper portion for dumping refuse into a hopper section of the vehicle body. The curved upper portion of the lift arm is pivotally connected to the vehicle body adjacent the hopper section. A power mechanism is mounted to extend and retract the lift arm from the side of the vehicle body. The lower end of the lift arm follows a curvilinear or arcuate path during extension and retraction. The upper end of the lift arm does not extend when its lower end is extended. This is an important advantage over existing automated side loaders because the present invention always dumps the refuse at the same position relative to the hopper section of the vehicle body, regardless of the amount or degree of extension of the lift arm. The frequency of spillage of refuse onto the street or sidewalk is reduced. Also, the hopper section need not be flared and therefore the width of the refuse vehicle body can be kept within legal limits.

DETAILED DESCRIPTION OF THE PREFERRED EMBODIMENT

The components of the boomless automated side loader hereafter described are generally made of steel, except for the elastomeric seals, hoses and other components associated with the hydraulic circuit.

Figure 1:
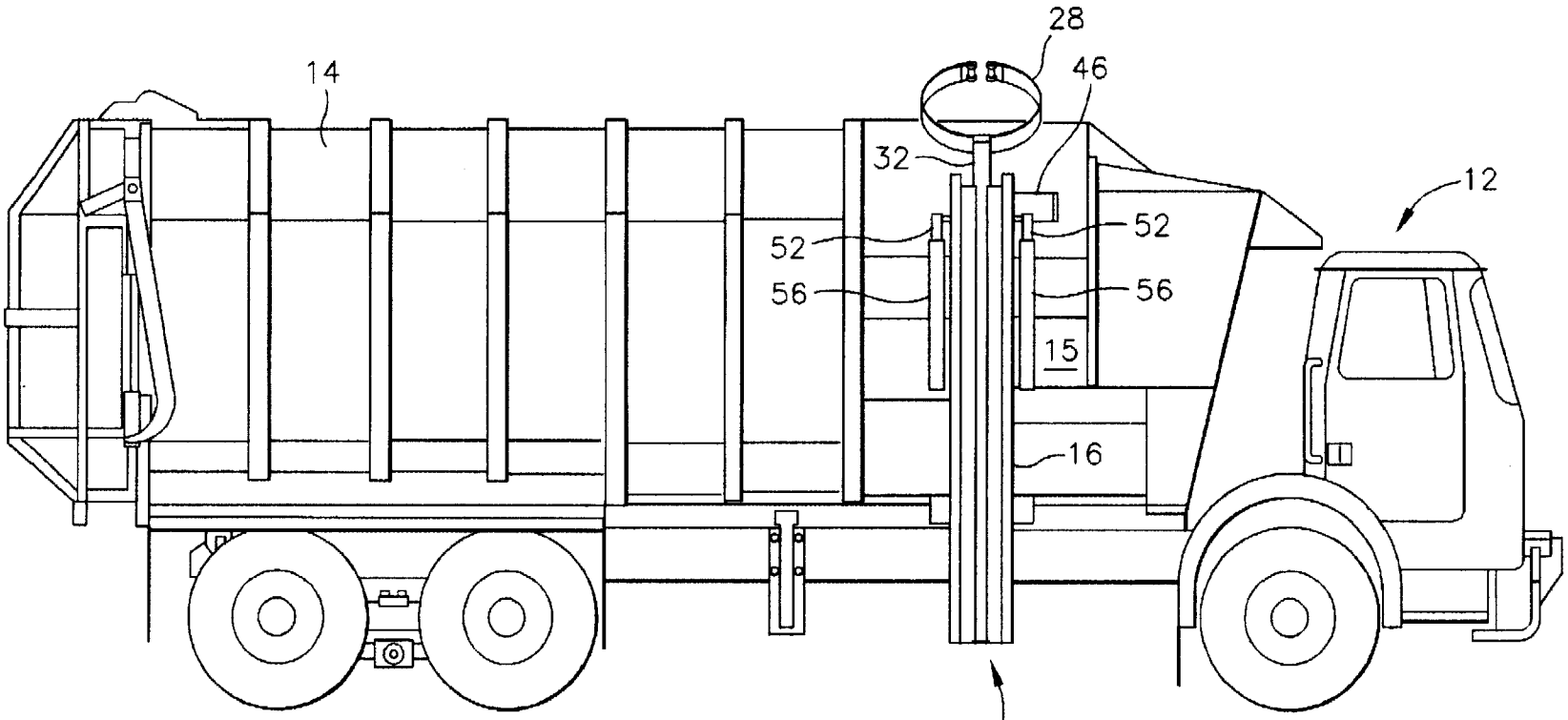
FIG. 1 is a side elevation view of a refuse collection vehicle equipped with an automated side loader in accordance with a preferred embodiment of the present invention.

Referring to FIG. 1, an automated side loader 10 is mounted to the side of a refuse collection vehicle 12. The vehicle 12 is equipped with a long hollow body 14 into which refuse is compacted in the conventional manner. The front end of the body 14 has an upwardly opening hopper section 15.

Figure 2:
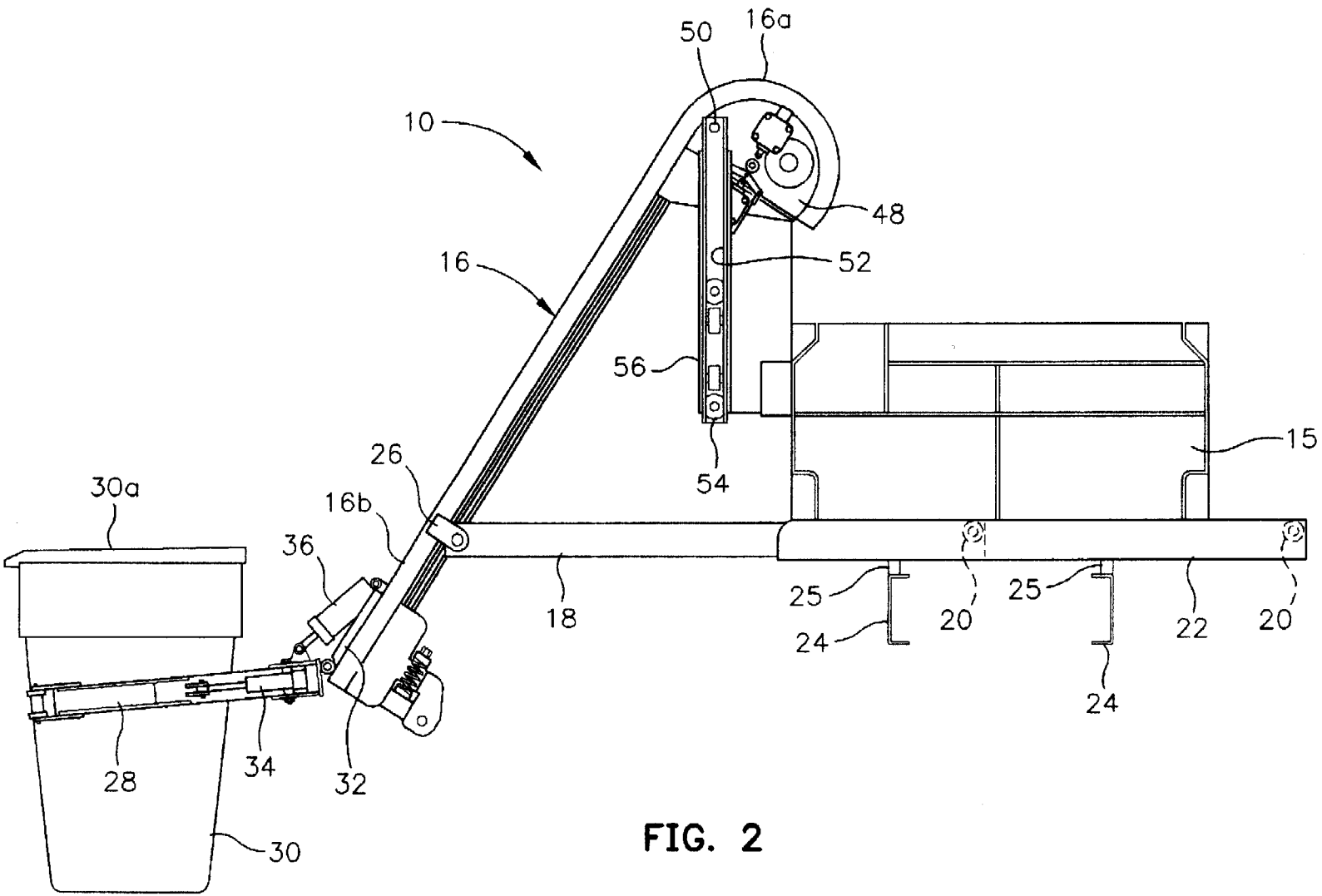
FIG. 2 is an enlarged, side elevation view illustrating the preferred embodiment in its fully extended position gripping a garbage can at the lower end of its lift arm.

Referring to FIG. 2, the side loader 10 includes a lift arm 16 generally having an inverted J-shape. The lift arm 16 is pivotally supported between its upper and lower ends on the outer ends of a pair of extendable horizontal support rails 18, only one of which is visible in FIG. 2. The support rails 18 slide in parallel relationship on rollers such as 20 journaled thereto inside of corresponding frame elements in the form of hollow box beams 22. The same roller 20 is illustrated in two different positions in FIG. 2 to show the extension and retraction of the support rails 18. The box beams 22 are welded to the underside of the hopper section 15 and rest on bumpers 25 mounted to a pair of longitudinal frame members 24 of the refuse collection vehicle 12. Only one of the box beams 22 is visible in FIG. 2. The box beams 22 extend transversely beneath the hopper section 15 of the body 14 of the refuse collection vehicle 12. Each box beam 22 receives a corresponding one of the support rails 18 in telescoping fashion. The outer ends of the support rails 18 are pivotally connected to opposite sides of the lift arm 16 by pin and bracket assemblies 26, only one of which is visible in FIG. 2.

Figure 3:
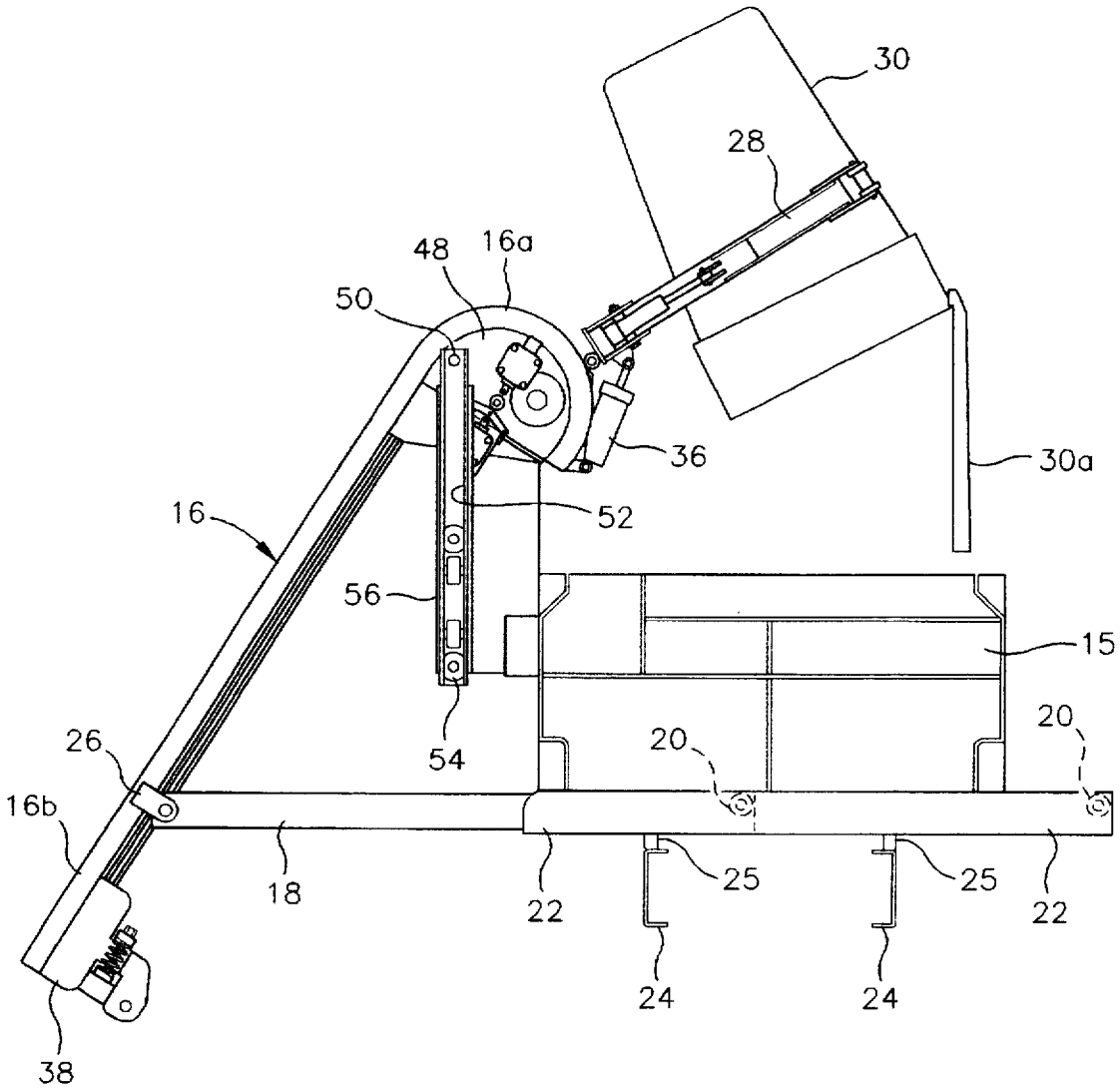
FIG. 3 is a side elevation view similar to FIG. 2 showing the garbage can being inverted over the hopper section of the vehicle body in order to dump its contents.

A pair of hydraulically actuated opposing grippers 28 are provided for engaging and holding a refuse container shown in the form of a conventional frusto-conical shaped garbage can 30. Only one of the grippers 28 is visible in FIG. 2. The grippers 28 are pivotally mounted to a carriage assembly 32 that is barely visible in FIG. 2. The carriage assembly 32 reciprocates along the length of the lift arm 16 to a curved upper portion **16*a* thereof for inverting the garbage can 30 and dumping the refuse contained therein into the hopper section 15 of the body 14, as illustrated in FIG. 3. The garbage can 30 has a hinged lid 30*a*** which swings open under the force of gravity.

Referring again to FIG. 2, grippers 28 are opened and closed by a pair of hydraulic cylinders 34, only one of which is visible. The grippers 28 and cylinders 34 provide a refuse container gripping mechanism. The grippers 28 are raised and lowered relative to the carriage assembly 32 by a pair of hydraulic leveling cylinders 36, all reciprocable with the carriage assembly 32. During extension and retraction of the lift arm 16, the leveling cylinders 36 are automatically actuated to maintain the grippers 28 at a substantially level attitude. This level attitude of the grippers 28 is maintained as the carriage assembly 32 travels up and down the straight portion **16*b* of the lift arm 16. This ensures that the garbage can 30 will be maintained in a vertical orientation until it is inverted so that none of its contents will spill onto the sidewalk or road. The straight portion 16*b* of the lift arm 16 has a stop assembly 38 attached to the lower end thereof for slowing the rate of travel of the carriage assembly 32** during final portion of its downward decent.

Figure 5:
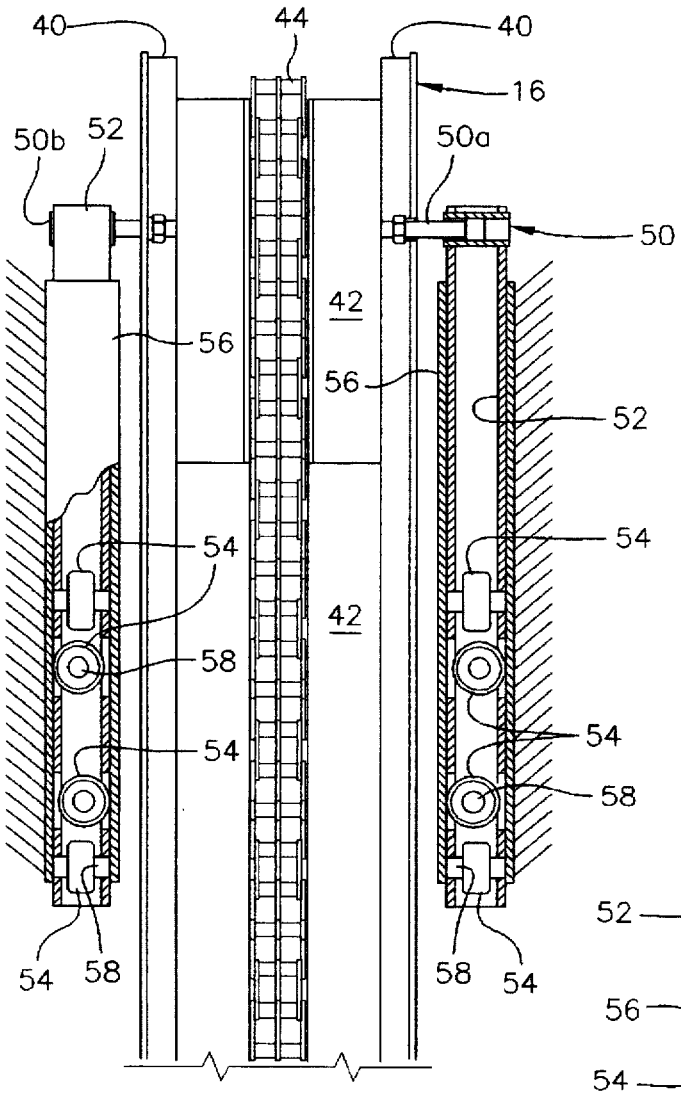
FIG. 5 is a greatly enlarged front elevation view of the preferred embodiment, with portions broken away, illustrating details of the pivotal attachment of the curved upper portion of the lift arm to the hopper section of the vehicle body.
Figure 6:
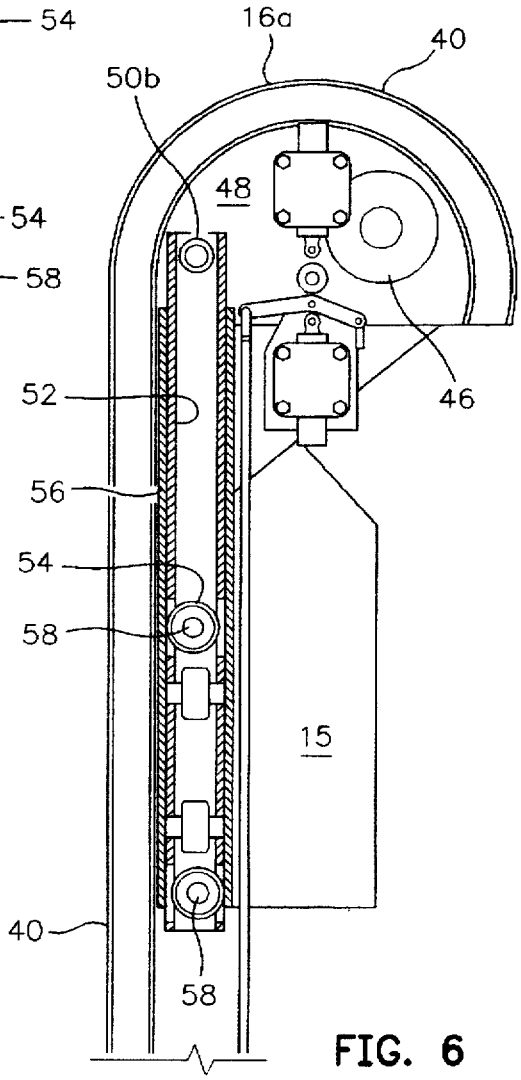
FIG. 6 is a greatly enlarged side elevation view of the lift arm of the preferred embodiment with portions broken away to reveal further details of the pivotal connection of the curved upper portion of the lift arm to the hopper section of the vehicle body.

Referring to FIG. 5, the lift arm 16 comprises spaced apart, parallel inverted J-shaped tracks 40 which are connected by sheet metal cross-members 42. The cross-members 42 define an outwardly opening channel for receiving and guiding a large drive chain 44. The carriage assembly 32 is connected to, and is moved up and down the lift arm 16 by, the drive chain 44. Drive sprockets supported by axles (not visible) are provided at the upper and lower ends of the lift arm. The drive chain 44 is entrained about these sprockets which are rotated by a hydraulic chain motor 46 (FIG. 6). The motor 46 is mounted to one of the two semicircular plates 48 that are welded inside the curved portions of the J-shaped tracks 40. The chain 44, drive sprockets and axles, and the motor 46 collectively provide a motor drive mechanism for moving the carriage assembly 32.

Figure 4:
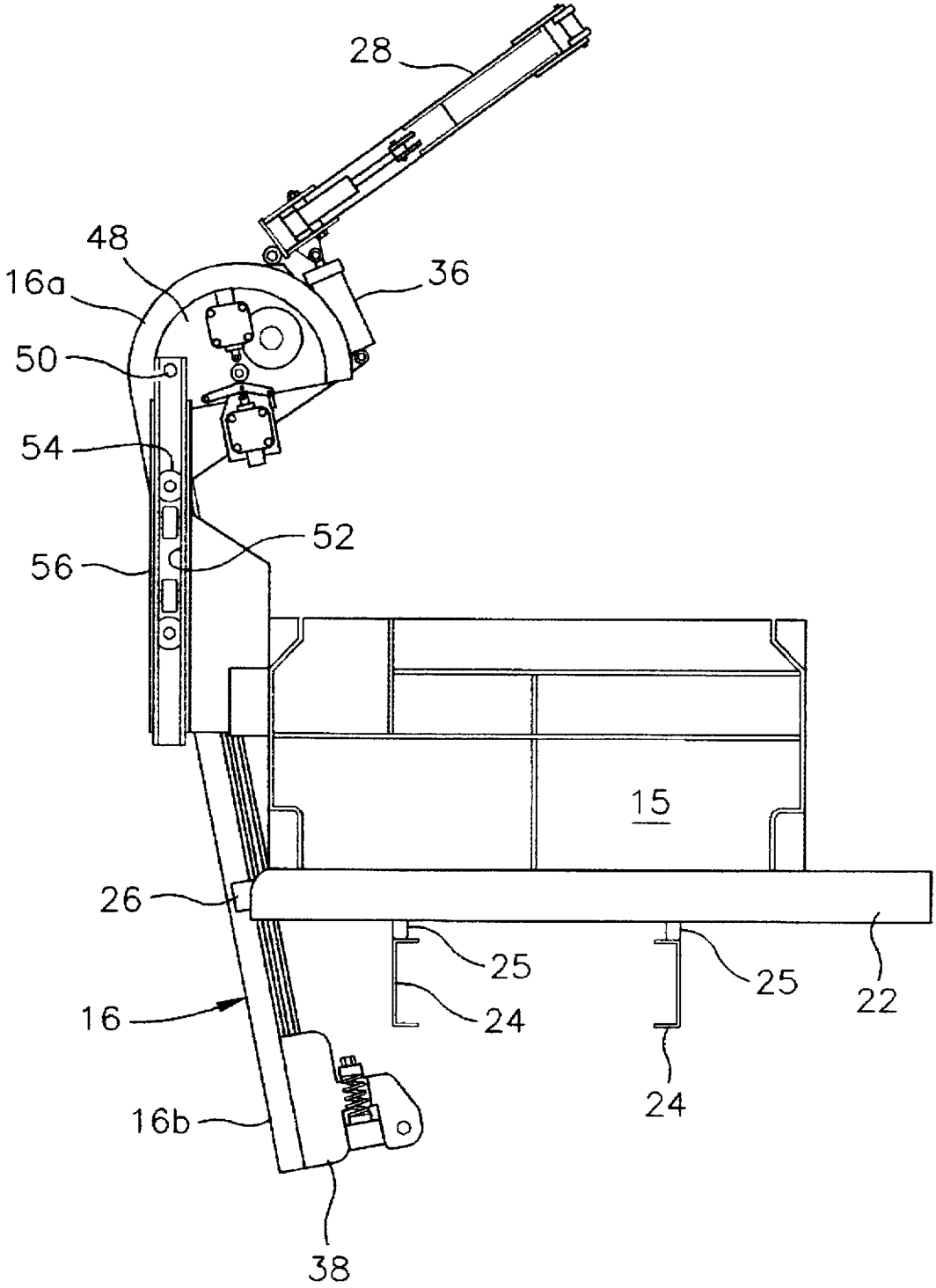
FIG. 4 is a side elevation view of the preferred embodiment with its lift arm in its completely retracted position.

The curved upper portion **16*a* of the lift arm 16 is pivotally connected to the hopper section 15 of the vehicle body 14 as hereafter described in detail. A power mechanism preferably in the form of a hydraulic piston and cylinder drive assembly (not visible in FIGS. 1–6) is preferably mounted horizontally to the underside of the hopper section 15 between the horizontal support rails 18. The outer end of the piston extends and retracts the lift arm 16 from the side of the vehicle body 14 between its fully extended position illustrated in FIG. 2 and its fully retracted position illustrated in FIG. 4, traveling through an angle greater than forty-five degrees. The lift arm is stowed in its fully retracted position when the vehicle 12 is traveling down the highway. The lift arm cylinder drive is shown diagrammatically as element 49** in the schematic diagram of FIG. 7, discussed hereafter.

The upper end of the lift arm 16 does not extend when its lower end is extended. As used herein with regard to the lift arm 16, the term "upper end" refers to the highest point on the curved upper portion **16*a* measured vertically from the road surface. The fact that the upper end of the lift arm 16 does not move away from the vehicle 12 when the lower end of the lift arm is extended represents a significant improvement over existing commercial designs. This is because the side loader 10 of the present invention always dumps the garbage can 30 at substantially the same position relative to the hopper section 15 regardless of the amount or degree of extension of the lift arm 16. Thus, it is unnecessary to retract the lift arm 16 to dump the garbage can 30, regardless of how far it is extended, unlike the aforementioned side loader of Bingman, et al. Because of the aforementioned configuration of my new automated side loader, the hopper section 15 need not be extensively flared. Therefore the width of the refuse vehicle body 14 can be kept within legal limits. Furthermore, by attaching the curved upper portion of the lift arm 16 to the vehicle body 14, the frequency of spillage of refuse over the outer edge of the hopper section 15** is substantially reduced.

The lower end of the lift arm 16 follows a curvilinear or arcuate path during its extension and retraction due to its pivotal connection to the rails 18 via pin and bracket assemblies 26. The lower end of the lift arm 16 can easily reach one hundred and eight inches from the side of the hopper section 15 when constructed in the relative proportions seen in FIG. 1 in comparison to the size of the vehicle 12. This provides so-called extended reach, allowing the driver of the vehicle to pick up garbage cans parked curbside by extending the lift arm 16 between parked cars.

The lift arm 16 is of conventional, well-known construction, except for the pivotal connection of its curved upper portion **16*a* to the hopper section 15 of the vehicle body 14. The aforementioned pivotal connection is described hereafter in detail. Therefore, the grippers 28, carriage assembly 32, gripper cylinders 34, leveling cylinders 36, stop assembly 38, tracks 40, motor 46 and lift arm cylinder drive 49** as well as related structures need not be described herein in further detail as they will be readily apparent to those of ordinary skill in the automated refuse collection art. For example, the conventional components are commercially available from Amrep, Inc. of Ontario, Calif., the assignee of the subject application, under the designation DUMPER-36.

The manner of pivotally connecting the curved upper portion 16*a* of the lift arm 16 to the vehicle body 14 will now be described in detail. The opposite sides of the curved upper portion 16*a* of the lift arm 16 are pivotally connected by corresponding bearing assemblies 50 to the upper ends of vertical guide arms 52. The guide arms 52 each slide on four vertically spaced rollers 54 within fixed vertical hollow guide tracks 56. The guide tracks 56 are welded to the outside surfaces of the hopper section 15. The rollers 54 are journaled on axles 58 which extend at right angles to one another within the guide arms 52. As can be seen in FIGS. 5 and 6, the guide tracks 56 have a square cross-section. The guide arms 52 also have a slightly smaller square cross-section. The ends of the axles 58 are seated in holes in the walls of the guide arms 52. The rollers 54 protrude through corresponding apertures in the walls of the guide arms 52 to engage one of the inside surfaces of the corresponding guide track 56.

The bearing assemblies 50 (FIG. 5) each include a stub shaft 50*a* having an inner end rigidly connected to the corresponding semi-circular plate 48. The outer end of each stub shaft is journed in a sleeve 50*b* which extends through the upper end of the corresponding guide arm 52.

There are no guide tracks welded across the curved upper portion 16*a* of the lift arm 16 which must ride along small rollers as utilized in a prior art design (DUMPER-36) extensively commercialized by Amrep, Inc. In that prior art design the lift arm is supported so that both its upper and lower ends move outwardly from the vehicle body. In the present invention, the combination of the bearing assemblies 50 and telescoping guide arms 52 and guide tracks 56 in the illustrated embodiment of the present invention provides a more durable and reliable means for pivotally securing the upper end of the lift arm to the vehicle body than the upper guide tracks and rollers utilized in the aforementioned prior art DUMPER-36 design commercialized by Amrep, Inc. The lift arm of the present invention does not vibrate as much, and is generally more stable than that of the DUMPER-36 design.

Figure 7:
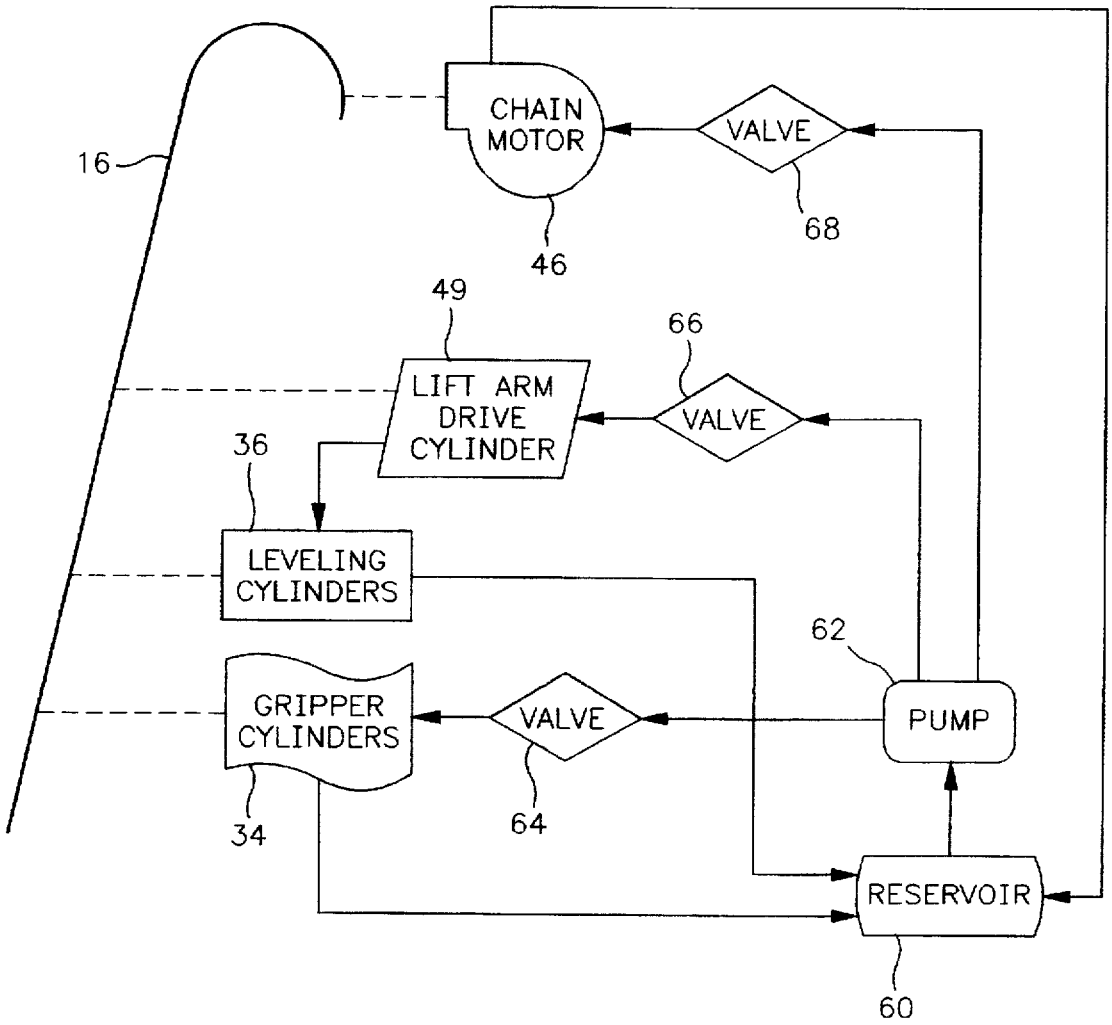
FIG. 7 is a greatly simplified schematic diagram of the hydraulic circuit of the preferred embodiment.

FIG. 7 is a greatly simplified schematic diagram of a hydraulic circuit for operating the lift arm 16 of the present invention. In this schematic diagram, the solid lines indicate hydraulic fluid flow paths. The gripper cylinders 34, leveling cylinders 36, chain motor 46 and lift arm drive cylinder 49 are drivingly connected to mechanical components of the lift arm 16 as indicated by the dashed lines in FIG. 7. Hydraulic fluid from a reservoir 60 carried by the vehicle 12 is delivered under relatively high pressure by a pump 62 to hydraulic valves 64, 66 and 68. These valves are in turn utilized to control the flow of hydraulic fluid to the gripper cylinders 34, lift arm drive cylinder 49 and chain motor 46, respectively. Hydraulic fluid from the gripper cylinders 34 and chain motor 46 is returned directly to the reservoir 60. Hydraulic fluid from the lift arm drive cylinder 49 is routed through the leveling cylinders 36 before returning to the reservoir 60. This automatically keeps the grippers 28 level during extension and retraction of the lift arm 16. The hydraulic valves 64, 66 and 68 are actuated by a combination of electrical and pneumatic control circuits (not illustrated). The hydraulic circuit of FIG. 7, along with the electrical and pneumatic circuits which control the same, are well known in the art, having been commercially available for many years from Amrep, Inc. as components of the DUMPER-36 unit. Therefore further details of these three circuits need not be described herein.

While I have described a preferred embodiment of my boomless automated side loader for refuse collection, it should be apparent to those skilled in the art that my invention may be modified in both arrangement and detail. Therefore, the scope of protection afforded my invention should only be limited in accordance with the following claims.

I claim:

1. An apparatus for mounting on the side of a vehicle for collecting refuse from containers positioned along a roadside, comprising:

a lift arm having a curved upper portion;

at least one support rail;

means for slidably mounting the support rail to a body of a vehicle for horizontal extension and retraction along a transverse direction;

means for pivotally connecting an outer end of the support rail to the lift arm between an upper end of the lift arm and a lower end of the lift arm;

means for extending and retracting the lift arm;

means for pivotally connecting the curved upper portion of the lift arm to the vehicle body adjacent a hopper section thereof so that the upper end of the lift arm does not move away from the vehicle body when the support rail is extended to move a lower end of the lift arm adjacent a refuse container positioned along a roadside;

carriage means mounted for translational movement along the lift arm between the lower end and a dump position along the curved upper portion;

means mounted on the carriage means for gripping a refuse container; and means for moving the carriage means between the lower end of the lift arm and the dump position along the curved upper portion of the lift arm;

whereby the dump position will not vary substantially in location relative to the hopper section, regardless of the amount of extension of the lower end of the lift arm away from the vehicle body.

2. An apparatus according to claim 1 wherein the means for pivotally connecting the curved upper portion of the lift arm to the vehicle body includes a pair of bearing assemblies each connected to a corresponding side of the lift arm adjacent the curved upper portion thereof.

3. An apparatus according to claim 2 wherein the means for pivotally connecting the curved upper portion of the lift arm to the vehicle body further includes a pair of vertical guide arms each having an upper end pivotally mounted to a corresponding one of the bearing assemblies.

4. An apparatus according to claim 3 wherein the means for pivotally connecting the curved upper portion of the lift arm to the vehicle body further includes a pair of guide tracks each vertically mounted to the hopper section for slidably receiving a corresponding one of the guide arms.

5. An apparatus according to claim 4 wherein the means for pivotally connecting the curved upper portion of the lift arm to the vehicle body further includes a plurality of rollers and means for rotatably mounting the rollers to the guide arms for engaging the guide tracks.

6. An apparatus according to claim 1 wherein the lift arm rotates through an angle greater than forty-five degrees when moved between a fully retracted position and a fully extended position.

7. An apparatus according to claim 2 wherein the bearing assemblies each extend outwardly from the curved upper portion of the lift arm.

8. An apparatus according to claim 3 wherein the guide arms have a rectangular cross-section.

9. An apparatus according to claim 4 wherein the guide tracks are hollow, have a rectangular cross-section, and enclose the guide arms.

10. An apparatus according to claim 2 wherein the bearing assemblies each include a stub shaft having an inner end rigidly connect to a corresponding side of the curved upper portion of the lift arm.

11. An apparatus for mounting on the side of a vehicle for collecting refuse from containers positioned along a roadside, comprising:

a lift arm having a curved upper portion;

at least one support rail;

a frame element configured to receive and guide the support rail for horizontal extension and retraction along a transverse direction;

a first pivotal connection between an outer end of the support rail and the lift arm located between an upper end of the lift arm and a lower end of the lift arm;

a power mechanism connected between the vehicle and the lift arm to extend and retract the lift arm;

a second pivotal connection between the curved upper portion of the lift arm and the vehicle body adjacent a hopper section thereof so that the upper end of the lift arm does not move away from the vehicle body when the support rail is extended and the lower end of the lift arm is moved adjacent a refuse container positioned along a roadside;

a container gripping mechanism;

a carriage supporting the container gripping mechanism and capable of translational movement between the lower end of the lift arm and a dump position along the curved upper portion of the lift arm; and a motor drive mechanism that moves the carriage between the lower end of the lift arm and the dump position along the curved upper portion of the lift arm.

12. An apparatus according to claim 11 wherein the second pivotal connection includes a pair of bearing assemblies each connected to a corresponding side of the lift arm adjacent the curved upper portion thereof.

13. An apparatus according to claim 12 wherein the second pivotal connection further includes a pair of vertical guide arms each having an upper end pivotally mounted to a corresponding one of the bearing assemblies.

14. An apparatus according to claim 13 wherein the second pivotal connection further includes a pair of guide tracks each vertically mounted to the hopper section for slidably receiving a corresponding one of the guide arms.

15. An apparatus according to claim 14 wherein the second pivotal connection further includes a plurality of rollers and means for rotatably mounting the rollers to the guide arms for engaging the guide tracks.

16. An apparatus according to claim 11 wherein the frame element comprises a box beam for receiving the support rail in telescoping fashion.

17. An apparatus according to claim 12 wherein the bearing assemblies each extend outwardly from the curved upper portion of the lift arm.

18. An apparatus according to claim 14 wherein the guide tracks are hollow, have a rectangular cross-section, and enclose the guide arms.

19. An apparatus according to claim 12 wherein the bearing assemblies each include a stub shaft having an inner end rigidly connect to a corresponding side of the curved upper portion of the lift arm.

20. A method of emptying the contents of a refuse container positioned along a roadside, comprising the steps of:

extending the lower end of a lift arm outwardly from the side of a refuse collection vehicle by sliding a horizontal support rail connected between the lift arm and the vehicle outwardly from the vehicle;

maintaining a pivotal connection between a curved upper portion of the lift arm and a refuse collection body on the vehicle during the extension of a lower end of the lift arm away from the vehicle;

engaging a refuse container with a gripping mechanism mounted to a carriage reciprocable along the length of the lift arm; and moving the carriage upwardly along the lift arm to the curved portion thereof in order to invert the refuse container and cause the contents thereof to be emptied into the refuse collection body;

whereby the contents of the refuse container will be emptied at a substantially uniform dump position relative to the refuse collection body regardless of the amount of extension of the lower end of the lift arm away from the vehicle.

* * * * *